US007064099B1

(12) United States Patent
Gassenmeier et al.

(10) Patent No.: US 7,064,099 B1
(45) Date of Patent: Jun. 20, 2006

(54) PROCESS FOR THE PRODUCTION OF PARTICULATE DETERGENTS

(75) Inventors: Thomas Gassenmeier, Duesseldorf (DE); Juergen Millhoff, Duesseldorf (DE); Peter Schmiedel, Duesseldorf (DE); Wolfgang Von Rybinski, Duesseldorf (DE); Ute Krupp, Essen (DE)

(73) Assignee: Henkel Kommanditgesellschaft Auf Aktlen, Dusseldorf (DE)

( * ) Notice: Subject to any disclaimer, the term of this patent is extended or adjusted under 35 U.S.C. 154(b) by 0 days.

(21) Appl. No.: 09/718,943

(22) Filed: Nov. 22, 2000

(30) Foreign Application Priority Data

Nov. 26, 1999 (DE) ..... 199 57 036

(51) Int. Cl.
*C11D 11/00* (2006.01)

(52) U.S. Cl. ..... 510/441; 510/491; 510/375; 252/186.27

(58) Field of Classification Search ..... 510/441, 510/477, 488, 509, 478, 491, 375; 252/186.27
See application file for complete search history.

(56) References Cited

U.S. PATENT DOCUMENTS

| | | | | | |
|---|---|---|---|---|---|
| 2,671,797 | A | * | 3/1954 | Hagemann et al. | 558/39 |
| 2,975,141 | A | * | 3/1961 | Blinoff et al. | 510/536 |
| 3,525,695 | A | | 8/1970 | Mouret et al. | |
| 3,847,830 | A | * | 11/1974 | Williams et al. | 252/186.26 |
| 3,908,045 | A | * | 9/1975 | Alterman et al. | 427/213 |
| 4,297,229 | A | * | 10/1981 | Speak et al. | 510/138 |
| 4,321,301 | A | * | 3/1982 | Brichard et al. | 428/403 |
| 4,327,151 | A | * | 4/1982 | Mazzola | 428/407 |
| 4,421,664 | A | * | 12/1983 | Anderson et al. | 510/374 |
| 4,421,669 | A | * | 12/1983 | Brichard | 252/186.25 |
| 4,734,224 | A | * | 3/1988 | Barrett et al. | 510/357 |
| 5,219,549 | A | * | 6/1993 | Onda et al. | 423/415 P |
| 5,443,751 | A | * | 8/1995 | Mazzola | 510/349 |
| 5,486,317 | A | * | 1/1996 | Dorset et al. | 510/444 |
| 5,489,399 | A | * | 2/1996 | Koyakumaru et al. | 252/373 |
| 5,505,875 | A | * | 4/1996 | Beaujean et al. | 252/186.27 |
| 5,556,834 | A | * | 9/1996 | James et al. | 510/375 |
| 5,573,697 | A | * | 11/1996 | Riddick et al. | 510/359 |
| 6,056,905 | A | * | 5/2000 | Akkermans et al. | 264/117 |
| 6,133,223 | A | * | 10/2000 | Sampaio et al. | 510/444 |
| 6,258,773 | B1 | * | 7/2001 | Mort, III et al. | 510/444 |

FOREIGN PATENT DOCUMENTS

| | | | | |
|---|---|---|---|---|
| DE | 140987 | A1 | * | 4/1980 |
| DE | 221377 | A1 | * | 4/1985 |
| DE | 228458 | A1 | * | 10/1985 |
| DE | 41 28 826 | A1 | | 3/1993 |
| DE | 4209924 | A1 | * | 9/1993 |
| DE | 43 44 831 | A1 | | 7/1995 |
| DE | 199 57 038 | | | 5/2001 |
| EP | 0 790 298 | A1 | | 8/1997 |
| EP | 0791647 | A2 | * | 8/1997 |
| FR | 2.180.864 | A | | 11/1973 |
| GB | 707994 | | * | 4/1954 |
| GB | 2 000 177 | A | | 1/1979 |
| GB | 2209172 | A | * | 5/1989 |
| GB | 2337054 | A | * | 10/1999 |
| JP | 03115496 | A2 | * | 5/1991 |
| WO | WO-92/17404 | A1 | * | 10/1992 |
| WO | WO-9217404 | A1 | * | 10/1992 |
| WO | WO-98/58048 | A1 | * | 12/1998 |

* cited by examiner

*Primary Examiner*—Lorna M. Douyon
(74) *Attorney, Agent, or Firm*—Connolly Bove Lodge & Hutz LLP

(57) ABSTRACT

A process for the production of particulate detergents or premixes suitable for their production by application of a flowable acidic component to a particle consisting at least partly of an alkaline detergent ingredient selected from the group consisting of alkali metal silicates, alkali metal alumosilicates, alkali metal perborates, alkali metal percarbonates, and mixtures thereof, the percentage of acidic component applied being governed by the formula $m_c/(m_c+m_p)=c\cdot l/r$, where $m_c$ is the weight of the acidic component, $m_p$ is the weight of the particle, r is the radius of the particle and c is a factor of 5 length units to 10 length units.

5 Claims, 1 Drawing Sheet

Fig.1. pH-Dependance Of Percarbonate Admixed With Stearic Acid
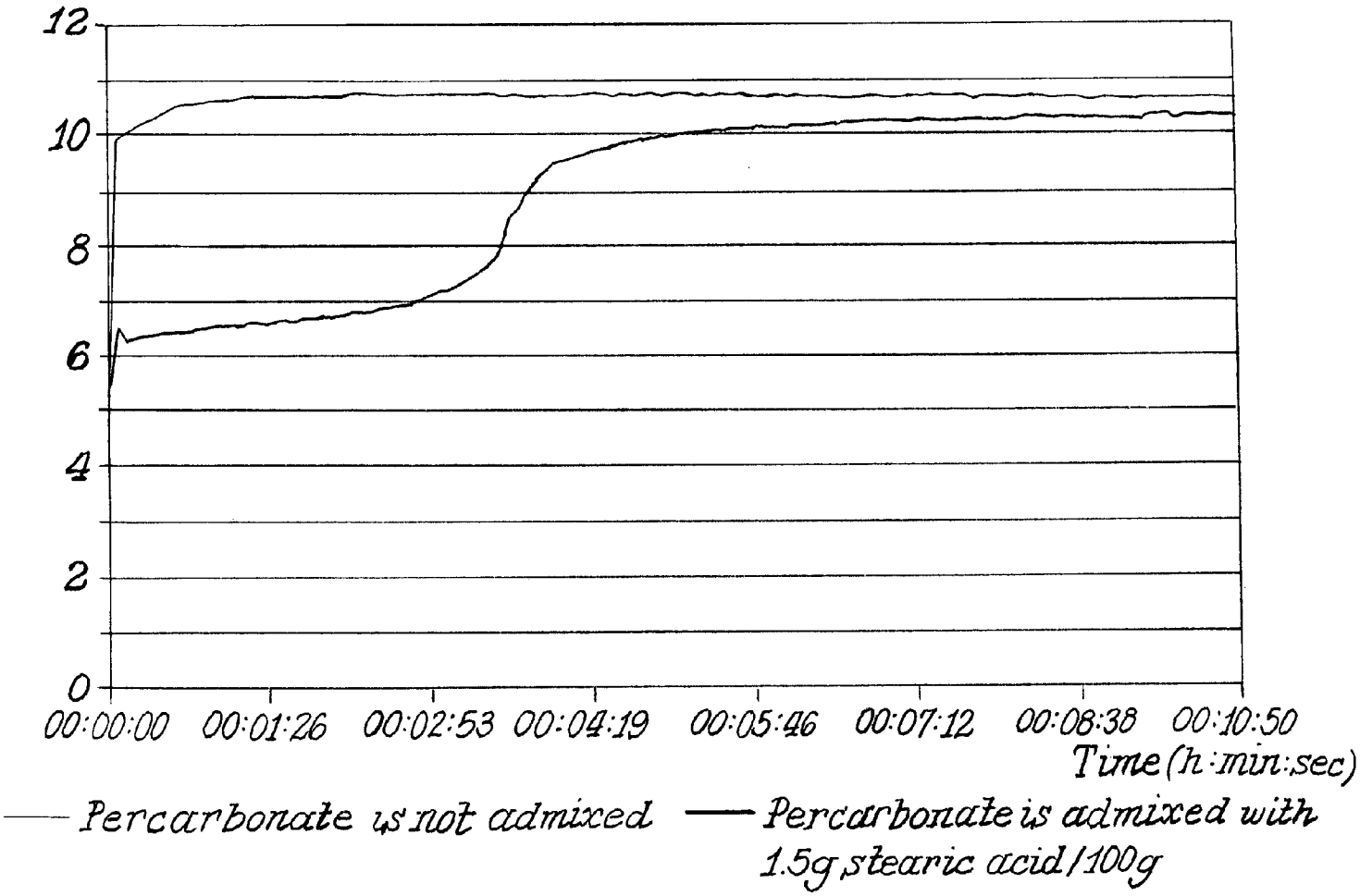

PROCESS FOR THE PRODUCTION OF PARTICULATE DETERGENTS

This invention relates to a process for the production of particulate detergents.

Particulate detergents normally consist of a plurality of ingredients which, owing to mutual incompatibilities, are normally distributed over several particulate components and incorporated thus in the detergent as a whole. Examples of such mutually incompatible ingredients are bleaching agent and bleach activator which, although intended to react with one another under in-use conditions, i.e. in aqueous solution, to develop the high bleaching performance required, must not react with one another during storage because, otherwise, they would no longer be available for the intended purpose.

A less graphic example of the non-optimal co-operation of individual detergent ingredients arises out of their pH-dependent performance. Whereas enzymes and certain bleaching systems, for example, have their optimum pH in the neutral or mildly acidic pH range, anionic surfactants and builders, for example, require an alkaline pH value in order fully to develop their effect. Speaking quite generally, both soil particles and most textile fibers develop an increasing number of negative charges with increasing pH value which results in increasing repulsion among them and hence contributes to the desired washing result. For this reason, the washing of textiles has for ages been carried out with more or less alkaline wash liquors. The same applies to aqueous solutions for cleaning hard surfaces, for example in machine dishwashing.

A way out of this dilemma of different pH optima for different ingredients is available via the time dimension of the washing/dishwashing process and consists in initially establishing a pH value at which certain ingredients develop their effect and then changing the pH so that other ingredients can develop theirs. In this way, each active ingredient finds its own optimal conditions which can differ from the optimal conditions of another active ingredient. A corresponding washing/dishwashing process in which the aqueous system used initially has a relatively low pH value which changes to a higher value after a certain time is the subject of German patent application DE 199 57 038.

In order to carry out this process, alkaline ingredients of the detergent used, which, as mentioned above, are essential to the favorable overall result of the process, have to be made up in such a way that they pass into the aqueous system at a later stage of the process and not at the beginning.

In the course of research work on this theme, it was found that this can be achieved by applying a reactive component to the alkaline particle, the quantity (to be applied) of component reacting with the alkaline particle on the surface being determined in a certain way by the diameter of the alkaline particle.

BRIEF DESCRIPTION OF THE DRAWINGS

FIG. 1 is plot of pH over time for a particle of percarbonate compounded with stearic acid according to the invention.

DESCRIPTION OF THE INVENTION

Accordingly, the present invention relates to a process for the production of particulate detergents or premixes suitable for their production by application of a flowable acidic component to a particle consisting at least partly of an alkaline detergent ingredient, the percentage of acidic component applied being governed by the formula $m_c/(m_c+m_p)=c\cdot l/r$, where $m_c$ is the weight of the acidic component, $m_p$ is the weight of the particle, r is the radius of the particle and c is a factor of 0.5 length units to 20 length units and more particularly 5 length units to 10 length units.

An acidic component or an alkaline detergent ingredient is understood to be a substance of which additions to water with a pH of 7 produces an acidic or alkaline pH value.

In the above formula, it is important to note that $m_c$ and $m_p$ or r and the unit of length used for c should share the same unit of size, for example kg and μm, respectively.

If several particles rather than just one particle are to be treated at the same time, as is generally the case, $m_p$ is understood to be the total weight of the particles to be treated and r their mean radius.

A particle to be treated in accordance with the invention may optionally contain all the ingredients of a detergent, i.e. it is possible by the process according to the invention to coat a preformed detergent. However, only at least some or all of the alkaline ingredients of such detergents are preferably treated in accordance with the invention, in which case the alkaline ingredients may be present as particulate individual substances or several of the alkaline ingredients may be present in a single particle to be treated. The alkaline ingredients in question are preferably alkali metal silicates, alkali metal aluminosilicates, alkali metal phosphates, alkali metal carbonates, alkali metal perborates and alkali metal percarbonates and mixtures thereof, sodium being the preferred alkali metal.

The process according to the invention is preferably carried out by applying the liquid or paste-form, optionally molten acidic component to the optionally heated particle consisting at least partly of an alkaline detergent ingredient in a mixer or granulator. Particularly good coating is achieved when the acidic component is applied to the particle over a period of 5 to 20 minutes.

Preferred acidic components include one or more mono- or dicarboxylic acids containing 10 to 22 carbon atoms, sulfuric acid monoalk(en)yl esters containing 10 to 20 carbon atoms, alk(en)yl or alkylaryl sulfonic acids containing 10 to 20 carbon atoms, and polymeric polycarboxylic acids obtainable by polymerization of ethylenically unsaturated mono- and/or dicarboxylic acids.

Although only a theoretical assumption to which applicants do not wish to be bound, the process according to the invention presumably creates a particularly dense and comparatively sparingly or slowly water-soluble coating, which remains reliably impermeable after introduction into an aqueous system and hence allows the production of detergents with a stepped pH profile, through the neutralization reaction of the acidic coating material with the alkaline particle on the surface thereof. The particles obtainable in accordance with the invention almost exclusively contain the ingredients of the particle originally used in their core. This core is surrounded by a layer in which increasingly higher concentrations of acidic coating material or the salt thereof formed with the alkaline component occur from inside outwards, the outer surface optionally being formed entirely by acidic coating material. This layered structure provides the coated particle with stepped dissolving behavior. On contact with water, hardly any alkaline material is dissolved from the coated particle for a certain time to begin with although, as soon as the coating has at least partly dissolved and no longer completely surrounds the particle, the pH value of the aqueous system increases so to speak suddenly through the release of the alkaline material from the core.

Besides the alkali metal component, constituents of the particle of alkaline material may be any typical detergent ingredients compatible with that component providing they are solid or can be made up in solid form. Such ingredients include, in particular, other builders, surfactants, other peroxygen compounds, peroxygen activators, sequestering agents, electrolytes and other auxiliaries, such as dye transfer inhibitors, silver corrosion inhibitors, foam regulators and dyes and perfumes, the presence of peroxygen activators in the particle of alkaline material being less preferred where that particle also contains peroxygen compound.

The particles produced by the process according to the invention are used as detergents for manual or machine washing or dishwashing, preferably after mixing with at least one other particulate component. In one preferred embodiment, the at least one other component contains at least one active ingredient of which the washing/cleaning effect is greater at a lower pH value than that established after dissolution of the alkali metal component present in the particle produced by the process according to the invention than it is at the pH value established during dissolution of the said particle. This active ingredient is preferably selected from enzymes or enzyme mixtures. In the case of the mixtures, the individual active ingredients may also be present in several particulate components differing in their composition. The at least one other component used may also have such a solubility that, under the initially lower pH conditions, it releases as much as possible of the active ingredient present which, however, only develops its full effect after an increase in pH through the then higher alkalinity of the aqueous system surrounding it or which otherwise reacts with the alkali metal component then released. One example of this particular variant is a bleach activator which is soluble or made up to dissolve at a relatively low pH and which reacts with a bleaching agent released from the particle coated in accordance with the invention and, because it is already dissolved, is capable of developing a strong bleaching effect extremely quickly.

EXAMPLES

Example 1

1 kg of spheronized sodium percarbonate with a mean particle diameter of 400 μm were premixed cold with 25 g of stearic acid (flakes). The resulting premix was transferred to a commercially available plowshare mixer with horseshoe blades preheated to 90° C. (casing temperature) in which it was reactively compounded for 20 mins. at speed stage 2 and at a measured product temperature of 80° C. The hot product was removed and, after cooling in the usual way, was used, for example, for the production of detergents.

Example 2

Quantities of 2.5 g and 1.5 g of stearic acid were added to quantities of 100 g of spheronized sodium percarbonate (mean particle diameter 1400 μm) in a glass beaker, followed by heating with stirring to around 80° C. After the molten stearic acid had been absorbed into the alkaline particles, the whole was reactively compounded for another 20 mins. at around 80° C.

The pH curve after incorporation in water of the product produced by application of 1.5 g of stearic acid is shown in FIG. 1. For comparison, FIG. 1 also shows the pH curve of the uncoated percarbonate.

The invention claimed is:

1. A process for the production of a particulate detergent or detergent premix component comprising the steps of coating a particle comprising one or more alkali metal percarbonates with a flowable acidic component consisting of stearic acid, to form particles wherein the amount of acidic component applied to the particle is governed by the formula $m_c/(m_c+m_p)=c\cdot l/r$, where $m_c$ is the weight of the acidic component applied, $m_p$ is the weight of the particle, r is the radius of the particle in μm, and c is a factor of 0.5 length units to 20 length units, and wherein the particulate detergent or detergent premix component has a stepped pH profile when contacted with water.

2. The process of claim 1, wherein the particle has a radius r of 100 μm to 1,000 μm.

3. The process of claim 1, wherein c is a factor of 5 length units to 10 length units.

4. The process of claim 1, wherein the flowable acidic component is solid at room temperature and is applied to the particle in a flowable form at a process temperature above room temperature.

5. The process of claim 1, wherein the acidic component is applied to the particle over a period of 5 minutes to 20 minutes.

* * * * *